US005109819A

United States Patent [19]

Custer et al.

[11] Patent Number: 5,109,819

[45] Date of Patent: May 5, 1992

[54] ACCELERATOR CONTROL SYSTEM FOR A MOTOR VEHICLE

[75] Inventors: Robert J. Custer; Mark R. Stepper, both of Columbus, Ind.

[73] Assignee: Cummins Electronics Company, Inc., Columbus, Ind.

[21] Appl. No.: 677,141

[22] Filed: Mar. 29, 1991

[51] Int. Cl.[5] ..... F02D 11/10; F02D 41/22

[52] U.S. Cl. ..... 123/399; 123/339

[58] Field of Search ..... 123/339, 350, 352, 359, 123/361, 399; 364/431.07

[56] References Cited

U.S. PATENT DOCUMENTS

| | | | |
|---|---|---|---|
| 4,305,359 | 12/1981 | Mann et al. | 123/399 X |
| 4,534,328 | 8/1985 | Fischer et al. | 123/359 |
| 4,597,049 | 6/1986 | Murakami | 123/350 X |
| 4,603,675 | 8/1986 | Junginger et al. | 123/399 X |
| 4,640,248 | 2/1987 | Stoltman | 123/399 |
| 4,739,469 | 4/1988 | Oshiage et al. | 364/187 |
| 4,793,308 | 12/1988 | Bräuninger et al. | 123/359 |
| 4,849,896 | 7/1989 | Bürk et al. | 123/399 X |
| 4,854,283 | 8/1989 | Kiyono et al. | 123/399 x |
| 4,881,502 | 11/1989 | Kabasin | 123/399 |
| 4,920,939 | 5/1990 | Gale | 123/399 |
| 4,979,117 | 12/1990 | Hattori et al. | 123/399 X |

FOREIGN PATENT DOCUMENTS

| | | | |
|---|---|---|---|
| 0206947 | 10/1985 | Japan | 123/399 |

OTHER PUBLICATIONS

Weimer, Cummins Engine Company letter dated Dec. 11, 1987.

SAE J1843, "Accelerator Pedal Position Sensor for Use With Electronic Controls in Medium- and Heavy-Duty Vehicle Applications," Prepared by S.A.E. Truck and Bus Diesel Engine Electronic Controls Subcommittee (Proposed Nov. 1990).

Lannan et al., "Cummins Electronic Controls for Heavy Duty Diesel Engines," *IEEE* 88 CH2533-8, International Congress on Transportation Electronics, Convergence 88, Dearborn, Mich., Oct. 17-18, 1988.

National Highway Traffic Safety Administration, DOT Standard No. 124, Jan. 1973.

*Primary Examiner*—Willis R. Wolfe

*Attorney, Agent, or Firm*—Woodard, Emhardt, Naughton, Moriarty & McNett

[57] ABSTRACT

An accelerator control system having an analog pedal position sensor and an idle switch capable of generating complementary output signals indicative of pedal position. The system includes a control circuit which commands the engine to an idle speed if the analog sensor indicates an idle state or if the complementary output signals together indicate an idle state. The system overrides the idle switch in the absence of complementary output signals therefrom and allows operation in response to the pedal position sensor as long as its output signal is within a predetermined range. Provision is made for operation at a reduced performance level in the event of an out-of-range failure of the analog sensor if the complementary output signals together indicate a non-idle condition.

16 Claims, 2 Drawing Sheets

ACCELERATOR CONTROL SYSTEM FOR A MOTOR VEHICLE

BACKGROUND OF THE INVENTION

This invention relates to accelerator control systems for motor vehicles, and more particularly to accelerator control systems capable of providing throttle idle validation for electronic engine controls.

Electronic engine control systems typically employ some form of electrical or electronic sensor of accelerator pedal position, such as a potentiometer mechanically linked to the accelerator pedal such that its wiper output signal is a linear function of pedal position. Examples of the above are disclosed in the following patents:

| Patent No. | Inventor | Issue Date |
|---|---|---|
| 4,534,328 | Fischer et al. | Aug. 13, 1985 |
| 4,597,049 | Murakami | Jun. 24, 1986 |
| 4,640,248 | Stoltman | Feb. 3, 1987 |
| 4,793,308 | Bräuninger et al. | Dec. 27, 1988 |
| 4,849,896 | Bürk et al. | Jul. 18, 1989 |
| 4,881,502 | Kabasin | Nov. 21 1989 |
| 4,979,117 | Hattori et al. | Dec. 18, 1990 |

Redundancy is provided in some systems in the form of an idle switch, which provides an independent idle position indication in the event of failure of the primary pedal position sensor. Such a system is disclosed in a paper by Lannan et al. entitled "Cummins Electronic Controls for Heavy Duty Diesel Engines," *IEEE* 88 CH2533-8, presented at the International Congress on Transportation Electronics, Convergence 88, Dearborn, Mich., Oct. 17–18, 1988. An idle switch and a potentiometer are also disclosed in U.S. Pat. No. 4,979,117 to Hattori et al., cited above, as part of a failure detection system which additionally employs a second switch for indication of the wide-open position of the accelerator pedal. If the potentiometer output voltage is outside a predetermined range, the system according to that patent allows vehicle operation at a speed determined by the switch states, e.g., idle speed if the idle switch indicates that the accelerator pedal is in its idle position, and some predetermined value above idle speed if the idle switch indicates a non-idle state. The same system detects malfunctions of the switches by comparing their actual states with expected states when the position sensor produces a mid-range output signal. U.S. Pat. No. 4,597,049 to Murakami, cited above, also discloses a pedal switch in addition to a potentiometer, for the purpose of generating a timing pulse when the accelerator pedal is depressed to accelerate the vehicle.

Another failure detection technique involves the use of a force sensor such as a strain gauge for sensing the force applied to the accelerator pedal, and for maintaining the engine at idle when the force applied is zero. This type of system, illustrated in the above-referenced U.S. Pat. Nos. 4,640,248 and 4,881,502 to Stoltman and Kabasin, respectively, is designed to provide fail-safe operation in the event the accelerator pedal sticks in an off-idle position. As pointed out in the latter patent, a pedal force sensor produces a false indication of idle state when the vehicle is operating in cruise control mode.

A well known drawback of redundant systems is that they often introduce new failure modes. One approach for avoiding the effects of such failure modes is disclosed in U.S. Pat. No. 4,739,469 to Oshiage et al., wherein it is suggested that replacement of a main control circuit with a backup circuit be carried out only when the backup circuit outputs a unique switching signal, such as a particular signal at or near a predetermined frequency or alternatively a plurality of parallel logical signals in a predetermined combination.

Despite substantial activity in this area, there remains a need for improved techniques for detecting sensor failures, for example, in-range position sensor failures, idle switch failures and the like, without complex, expensive or unreliable sensors or circuits which may introduce further undesirable failure modes.

SUMMARY OF THE INVENTION

According to one aspect of the present invention, an analog Pedal sensor is combined with an idle switch assembly capable of generating complementary output signals indicative of pedal position. The system includes a control circuit which commands the engine to an idle speed if the analog sensor indicates an idle state or if the complementary outputs of the idle switch assembly together indicate an idle state.

Another aspect of the invention provides in-range failure detection, i.e., detection of sensor failure even in the presence of a sensor output signal in the normal operating range of the sensor, and detection of false failure indications. According to this aspect of the invention, an idle indication from the idle switch coupled with an output signal from the position sensor beyond a certain level indicative of a non-idle state is treated as an in-range sensor failure, whereupon a routine is initiated for detection of a possible false failure indication based upon an alternating sequence of idle and non-idle indications from both sensors.

A general object of the present invention is to provide an improved accelerator control system for an electronic engine control system for motor vehicles.

Another object is to minimize failure mode effects on engine operation consistent with equipment and operator safety.

Another object is to provide a throttle idle validation system which is less vulnerable to conditions in the operating environment of a motor vehicle which can produce false indications of sensor failure in some existing systems These and other objects and advantages of the present invention will be more apparent in view of the following detailed description of the preferred embodiment taken in conjunction with the accompanying drawings.

DESCRIPTION OF THE PREFERRED EMBODIMENT

Figure 1:
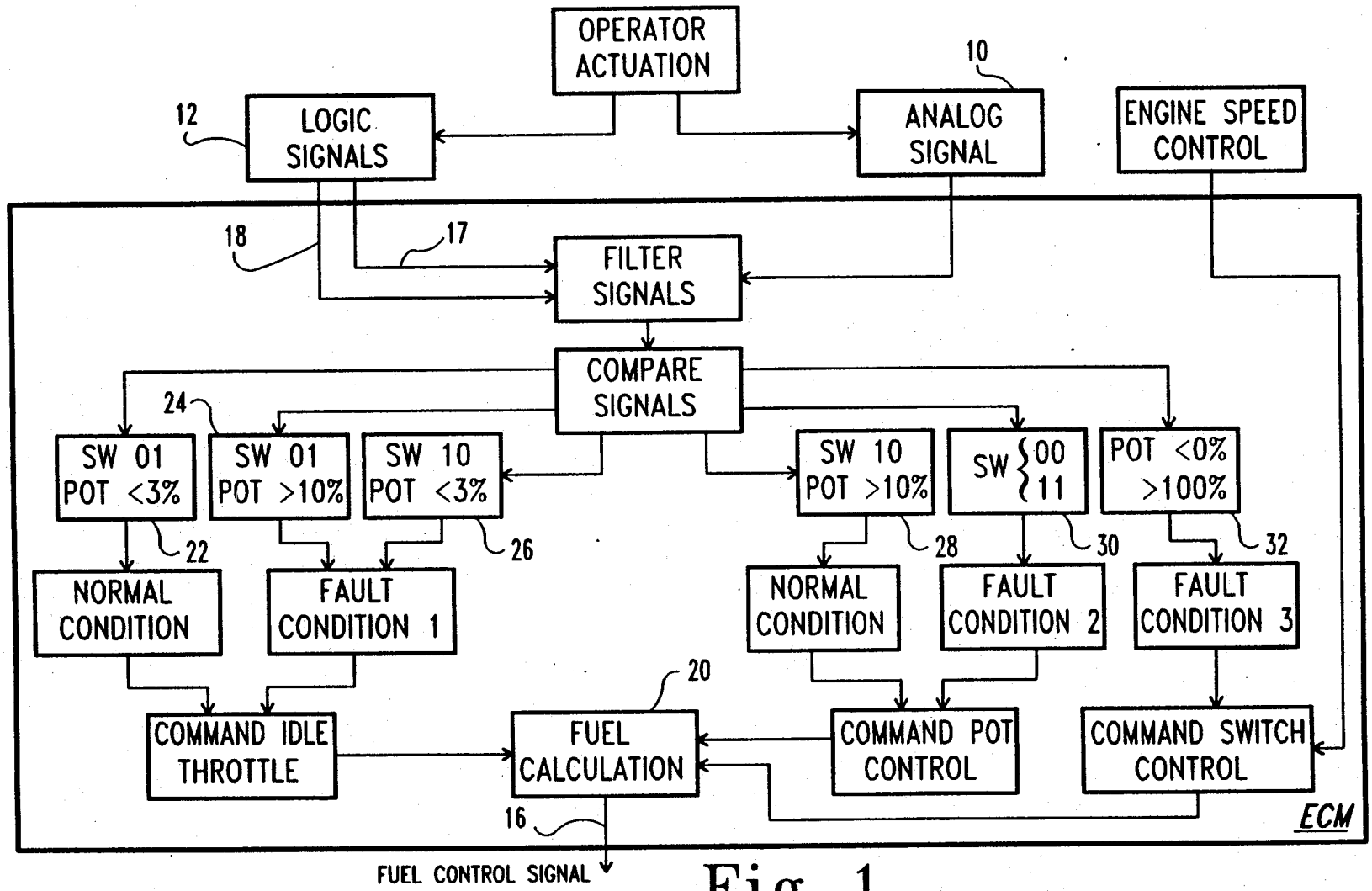
FIG. 1 is a block diagram of a throttle idle validation system according to the preferred embodiment of the present invention.

For the purposes of promoting an understanding of the principles of the invention, reference will now be made to the embodiment illustrated in the drawings and specific language will be used to describe the same It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

With reference to FIG. 1, the preferred embodiment of the present invention includes an electrical throttle subsystem which produces three electrical signals from two independent voltage sources as a result of the driver-operated accelerator pedal. The first signal is an analog voltage ratiometric to the accelerator pedal position, and is generated by an analog signal source or sensor 10, preferably a potentiometer (pot), electrically energized by a source of DC voltage and having its wiper arm mechanically coupled to the accelerator pedal. The two other signals are complementary logic level signals produced by a logic signal source 12, preferably an idle switch, which is mechanically coupled to the accelerator pedal such that the logic signals change state at a known position related to the mechanical position of the accelerator pedal at idle. The idle switch is preferably a single-pole, double-throw (SPDT) switch of the form C (break-before-make) type.

The single output from potentiometer 10 and the complementary outputs from idle switch 12 are supplied to an electronic control module (ECM) 14 which filters the signals and processes them in a manner to be described, generating an appropriate fuel control signal 16 based on a fuel calculation routine 20. Potentiometer 10 is the primary pedal position sensor, and idle switch 12 serves as an auxiliary or backup position sensor, the primary function of which is to provide an independent idle position indication and thereby enable detection of a failure in the primary position sensor assembly. ECM 14 includes a microprocessor which is programmed to respond to the output signals from potentiometer 10 and idle switch 12 in such a way as to command the engine to an idle speed as a result of a failure of potentiometer 10 to generate an output signal corresponding to idle state when the accelerator pedal is in its idle position as detected by idle switch 12 (block 24). The idle switch is electrically connected so as to produce a low logic level (logic "0") on one output 17 and a high logic level (logic "1") on another output 18 when the pedal is in its idle position, and to produce the opposite logic level at each output when the pedal is not in its idle position. Thus, generally, the ECM produces a throttle control signal in accordance with the potentiometer output signal in the presence of a 10 state on idle switch outputs 17 and 18 (block 28), and produces an idle speed control signal in the presence of a 01 state on the idle switch outputs (block 22 or 24). Output 17 is connected to the normally-open contact of the switch, and output 18 is connected to the normally-closed contact. Switch common is connected to the voltage supply, and outputs 17 and 18 are both biased to a low state, whereby the switch produces a 01 (idle) output in the event the switch becomes mechanically disconnected. This Provides failsafe operation and also deters tampering.

Figure 2:
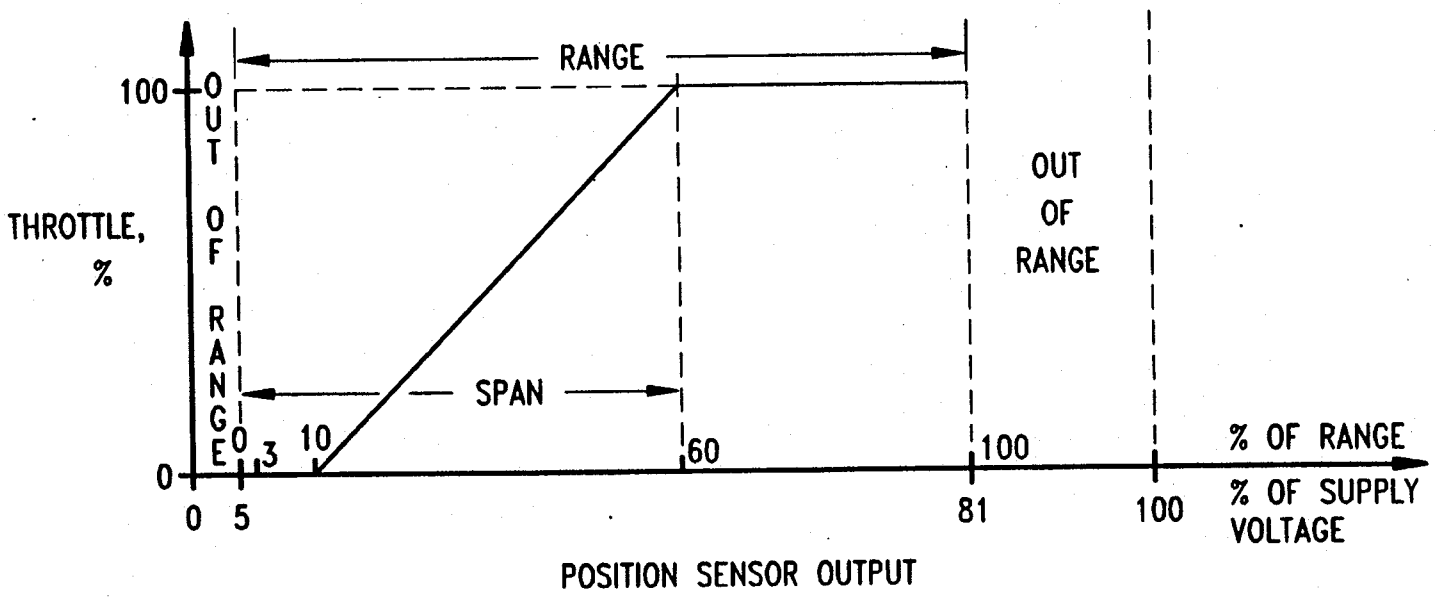
FIG. 2 is a graph of the relationship between position sensor output and commanded throttle level.

Potentiometer 10 is supplied with a DC voltage, e.g., 5 volts, and the ECM defines an allowable operating range for the pot which, in the presently preferred embodiment, extends from 5% to 81% of the supply voltage. The ECM also defines a sensor span within the operating range just defined. The span is 60% of the operating range, and preferably floats, as will be described shortly. In an embodiment with a non-floating span, the lower end of the span is 5% of the supply voltage, which is specified as 0% of the operating range in FIG. 2, and the upper end of the span is that voltage plus 60% of the 5-81% operating range, as illustrated. As shown in FIG. 2, the throttle command signal generated by the ECM is 0% throttle below the 10% point, which equals the lower end value of the span plus 10% of the 5-81% operating range Similarly, the span also has a 3% point, which equals the lower end value of the span plus 3% of the 5-81% operating range. From the 10% Point in the span to the upper end, the throttle command signal is a linear function of the sensor output. Above the upper end of the span, the throttle command signal is 100% throttle.

If the potentiometer output voltage is out of range, the ECM generates an out-of-range indication (fault condition 3) for the potentiometer and operates according to the inputs from the idle switch if complementary, defaulting to idle in the presence of an idle indication and, in the presence of a non-idle indication, generating a throttle control signal corresponding to full throttle but limiting the acceleration rate of the vehicle. The operator can maintain some control over vehicle speed in this situation by modulating the pedal position, i.e., alternately pressing and releasing the pedal as necessary for a desired speed. The system thereby allows vehicle operation at a reduced performance level in the event of an out-of-range failure of the primary accelerator pedal sensor. If the primary sensor returns in-range, the fault condition is terminated, although the ECM retains a record of the fault by counting all faults and storing the time of the most recent fault.

The ECM is programmed to allow normal operation in the absence of detected complementary logic states from idle switch 12, as long as the pot is not out of range. In either of the two possible cases (00 and 11), indicated in block 30, the ECM generates a fault indication (fault condition 2) for the idle switch and continues to control the throttle mechanism in accordance with the output signal from potentiometer 10 if in range. If the pot is out of the allowable range, the system defaults to idle speed.

In-range failure detection is also provided by the preferred embodiment of the present invention. If the idle switch is in an idle state when the potentiometer output voltage is above the 10% point in the above-defined span (block 24), the ECM generates an indication of an in-range failure (fault condition 1), defaults to idle and enters an ALL CLEAR routine designed to allow a return to normal operation in cases of intermittent failure. The safe fault condition occurs if the idle switch is in the non-idle state and the pot voltage is below the 3% point in the span (block 26). According to the ALL CLEAR routine, if the operator presses and releases the pedal a predetermined number of times and the potentiometer and idle switch respond appropriately each time, the fault condition is cleared and the system is returned to normal operation. If the pedal pumping fails to produce a proper alternating sequence of idle and non-idle indications from both sensors, the system maintains the engine at idle speed. More specifically, the ECM checks for the occurrence of either one of the following normal states:

(1) Non-idle state
  (a) Pot output above 10% point in span; and
  (b) 10 output from idle switch
(2) Idle state
  (a) Pot output below 3% point in span; and (b) 01 output from idle switch If either normal state is detected, the ECM then looks for the other state, and counts each time a normal state is detected. If the number of normal states detected within a predetermined amount of time, preferably approximately 5 seconds, exceeds the predetermined number, preferably 3, the ECM clears the fault indication. Although the engine is normally set to idle whenever the pot output is below the 10% point, outputs between 3% and 10% are not considered in identifying idle state for purposes of this routine because the state of the idle switch is uncertain in that region, as a result of switch hysteresis, mounting tolerances and the like. The ALL CLEAR routine also executes during fault condition 2.

One advantage of dual idle switch outputs is that the system is less susceptible to conditions which could cause a false indication of an in-range failure of the position sensor if there were only one idle switch output, such as in the case of an intermittent open circuit in a connector or elsewhere in the wiring harness between the idle switch and the engine control module, which is preferably mounted on the engine in diesel engine applications. This is because one open connection is enough for a false idle indication from, for example, a single SPST switch, whereas the system with dual switch outputs according to this invention requires more than a single point failure to produce a false idle indication. In particular, the states of outputs 17 and 18 as sensed by the ECM must be complementary low and high logic levels, respectively, which cannot occur as a result of an open connection in both lines.

Idle switch 12 is preferably an SPDT switch, as described above, but may alternatively be implemented with individual SPST switches independently mounted to the pedal so as to change state simultaneously but independently. These switches are preferably wired so as to produce complementary outputs as in the embodiment described above.

In an alternative embodiment, the position sensor 10 is a digital pulse generator having a control element coupled to the Pedal such that pedal position modulates the pulse train, e.g., by pulse width modulation, frequency modulation, or other known modulation techniques.

In a particularly preferred embodiment, the ECM operates with a floating span for the analog sensor. In this embodiment, the ECM sets the lower end of the span equal to the lowest detected voltage supplied by the sensor, and sets the upper end of the span and the 3% and 10% points within the span by adding 60%, 3%, and 10% of the 5-81% operating range, respectively, to the lower end value. The ECM is thus self-calibrating. That is, it automatically compensates for Pedal tolerances and the like.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

We claim:

1. An accelerator control system for a motor vehicle having an accelerator pedal, comprising:

primary input means for receiving a primary signal indicative of accelerator pedal position;

auxiliary input means for receiving a complementary pair of auxiliary signals indicative of accelerator pedal position; and control circuit means for generating a throttle control signal in accordance with said primary signal and said complementary pair of auxiliary signals, said control circuit means including means for generating a throttle control signal corresponding to a throttle idle position when said primary signal or said complementary pair of auxiliary signals indicate an idle state.

2. The accelerator control system of claim 1, wherein said control circuit means includes means for inhibiting operation according to said auxiliary signals when said auxiliary signals are not complementary.

3. The accelerator control system of claim 2, wherein said control circuit means further includes means for detecting an in-range failure condition of said primary signal, and means responsive to said primary signal and said complementary pair of auxiliary signals for detecting a false indication of said in-range failure condition.

4. The accelerator control system of claim 3, wherein said control circuit means further includes means responsive to an out-of-range condition of said primary signal for generating a throttle control signal corresponding to a non-idle throttle level if said auxiliary signals both indicate a non-idle state.

5. The accelerator control system of claim 4, further comprising:

a potentiometer mechanically connected to said accelerator pedal and electrically connected to said primary input means; and an SPDT switch mechanically connected to accelerator pedal and electrically connected to said auxiliary input means.

6. The accelerator control system of claim 1, wherein said control circuit means includes means for detecting an in-range failure condition of said primary signal, and means responsive to said primary signal and said complementary pair of auxiliary signals for detecting a false indication of said in-range failure condition.

7. The accelerator control system of claim 1, wherein said control circuit means includes means responsive to an out-of-range condition of said primary signal for generating a throttle control signal corresponding to a non-idle throttle level if said auxiliary signals both indicate a non-idle state.

8. The accelerator control system of claim 1, further comprising:

a potentiometer mechanically connected to said accelerator pedal and electrically connected to said primary input means; and an SPDT switch mechanically connected to accelerator pedal and electrically connected to said auxiliary input means.

9. An accelerator control method for a motor vehicle having an accelerator pedal, comprising the steps:

receiving a primary signal indicative of accelerator pedal position;

receiving a complementary pair of auxiliary signals indicative of accelerator pedal position; and generating a throttle control signal in accordance with said primary signal and said complementary pair of auxiliary signals, said generating step including generating a throttle control signal corresponding to a throttle idle position when said primary signal or said complementary pair of auxiliary signals indicate an idle state.

10. The accelerator control method of claim 9, wherein said generating step includes inhibiting operation according to said auxiliary signals when said auxiliary signals are not complementary.

11. The accelerator control method of claim 10, wherein said generating step further includes detecting an in-range failure condition of said primary signal, and detecting a false indication of said in-range failure condition based on said primary signal and said complementary pair of auxiliary signals.

12. The accelerator control method of claim 11, wherein said generating step further includes responding to an out-of-range condition of said primary signal by generating a throttle control signal corresponding to a non-idle throttle level if said auxiliary signals both indicate a non-idle state.

13. The accelerator control method of claim 12, further comprising the steps:

generating said primary signal with a potentiometer mechanically connected to said accelerator pedal;

generating said complementary pair of auxiliary signals with an SPDT switch mechanically connected to said accelerator pedal.

14. The accelerator control method of claim 9, wherein said generating step includes detecting an in-range failure condition of said primary signal, and detecting a false indication of said in-range failure condition based on said primary signal and said complementary pair of auxiliary signals.

15. The accelerator control method of claim 9, wherein said generating step includes responding to an out-of-range condition of said primary signal by generating a throttle control signal corresponding to a non-idle throttle level if said auxiliary signals both indicate a non-idle state.

16. The accelerator control method of claim 9, further comprising the steps:

generating said primary signal with a potentiometer mechanically connected to said accelerator pedal;

generating said complementary pair of auxiliary signals with an SPDT switch mechanically connected to said accelerator pedal.

* * * * *

UNITED STATES PATENT AND TRADEMARK OFFICE

CERTIFICATE OF CORRECTION

PATENT NO. : 5,109,819

DATED : May 5, 1992

INVENTOR(S) : Robert J. Custer et al.

It is certified that error appears in the above-identified patent and that said Letters Patent is hereby corrected as shown below:

On the title page, please add the following to Abstract, line 16 --In-range failure detection is also provided, along with a method of detecting a false indication of an in-range failure.--

In column 2, line 19, please change "Pedal" to --pedal--.

In column 2, line 48, please insert a period after "systems".

In column 2, line 67, please insert a period after "same".

In column 3, lines 59 and 60, please change "Provides" to --provides--.

In column 4, line 8, please insert a period after "range".

In column 4, line 11, please change "Point" to --point--.

In column 4, line 51, please change "safe" to --same--.

In column 5, line 42, please change "Pedal" to --pedal--.

In column 5, line 55, please change "Pedal" to --pedal--.

Signed and Sealed this

Third Day of August, 1993

Michael K. Kirk

*Attest:*

MICHAEL K. KIRK

*Attesting Officer*

*Acting Commissioner of Patents and Trademarks*